US008215571B2

(12) United States Patent
Yu

(10) Patent No.: US 8,215,571 B2
(45) Date of Patent: Jul. 10, 2012

(54) PERFUME BOTTLE SPRAY HEAD ASSEMBLY

(75) Inventor: Yuan-Wen Yu, Chung-Li (TW)

(73) Assignee: Ing Wen Precision Ent. Co., Ltd., Chung-Li, Taoyuan Hsien (TW)

( * ) Notice: Subject to any disclaimer, the term of this patent is extended or adjusted under 35 U.S.C. 154(b) by 538 days.

(21) Appl. No.: 12/511,072

(22) Filed: Jul. 29, 2009

(65) Prior Publication Data

US 2011/0024525 A1 Feb. 3, 2011

(51) Int. Cl.
*B05B 7/26* (2006.01)

(52) U.S. Cl. ..... 239/311; 239/318; 239/337; 239/354; 239/363; 239/407; 239/434; 239/581.1

(58) Field of Classification Search ..... 137/893; 222/153.13, 631–633; 239/310, 311, 318, 239/337, 349, 354, 355, 356, 360–363, 369–371, 239/391, 396, 407, 416, 417.5, 433, 434, 239/581.1; 251/213, 340

See application file for complete search history.

(56) References Cited

U.S. PATENT DOCUMENTS

| | | | | |
|---|---|---|---|---|
| 2,086,626 | A * | 7/1937 | Lohse | 239/354 |
| 2,125,573 | A * | 8/1938 | Kelley, Jr. | 239/353 |
| 2,755,131 | A * | 7/1956 | Croce | 239/73 |
| 3,196,924 | A * | 7/1965 | Kaminga | 431/344 |
| 7,080,761 | B1 * | 7/2006 | Yu | 222/633 |
| 7,490,742 | B2 * | 2/2009 | Yu | 222/183 |
| 7,559,441 | B2 * | 7/2009 | Yu | 222/183 |
| 7,793,866 | B2 * | 9/2010 | Chou | 239/354 |
| 2011/0076323 | A1 * | 3/2011 | Monsonego et al. | 424/450 |

* cited by examiner

*Primary Examiner* — Jason Boeckmann

(57) ABSTRACT

A perfume bottle spray head assembly is disclosed to include a nozzle head, a lock cap, a receptacle, a plug, a dip tube, an outer cap and a rotary shut-off control plate. The nozzle head has passage means defined therein to facilitate mixing of liquid perfume with compressed air for enabling well-mixed liquid perfume and compressed air mixture to be sprayed out in a mist. The rotary shut-off control plate is operable to rotate the plug in the receptacle between a close position to shut off the liquid perfume passage and an open position to open the liquid perfume passage.

4 Claims, 9 Drawing Sheets

PERFUME BOTTLE SPRAY HEAD ASSEMBLY

BACKGROUND OF THE INVENTION

1. Field of the Invention

The present invention relates to a perfume bottle and more particularly, to a perfume bottle sealing structure that shuts off the perfume passage of the perfume bottle, preventing leakage during transportation.

2. Description of the Related Art

A regular spray type perfume bottle generally has a hand pump operable to provide compressed air for mixing with the liquid perfume and forcing the liquid perfume and compressed air mixture out of a nozzle in the form of a mist. Because the nozzle head of a regular spray type perfume bottle is comprised of a number of small component parts, the installation of the nozzle head is complicated, and the component parts may be not kept in position accurately after installation. Further, the narrow liquid perfume passage in the nozzle head of a conventional spray type perfume bottle tends to be blocked. In this case, liquid perfume and compressed air cannot be well mixed to produce a fine mist. Further, conventional spray type perfume bottles do not have any shut-off structure, contained liquid perform may leak during transportation under a high temperature environment.

SUMMARY OF THE INVENTION

The present invention has been accomplished under the circumstances in view. It is one object of the present invention to provide a perfume bottle spray head assembly for perfume sprayer, which has switching means to close/open the liquid perfume passage, preventing leakage during transportation of the perfume sprayer.

To achieve this and other objects of the present invention, the perfume bottle spray head assembly comprises a nozzle head, a lock cap, a receptacle, a plug, a dip tube, an outer cap and a rotary shut-off control plate. The nozzle head has passage means defined therein to facilitate mixing of liquid perfume with compressed air for enabling well-mixed liquid perfume and compressed air mixture to be sprayed out in a mist. The rotary shut-off control plate is operable to rotate the plug in the receptacle between a close position to shut off the liquid perfume passage and an open position to open the liquid perfume passage.

When operating the rotary shut-off control plate to rotate the plug, the nozzle head with the connected hand pump are not moved with the plug. Thus, the perfume sprayer needs not to provide an extra space for allowing movement of the hand pump relative to the perfume bottle.

DETAILED DESCRIPTION OF THE PREFERRED EMBODIMENT

Figure 1:
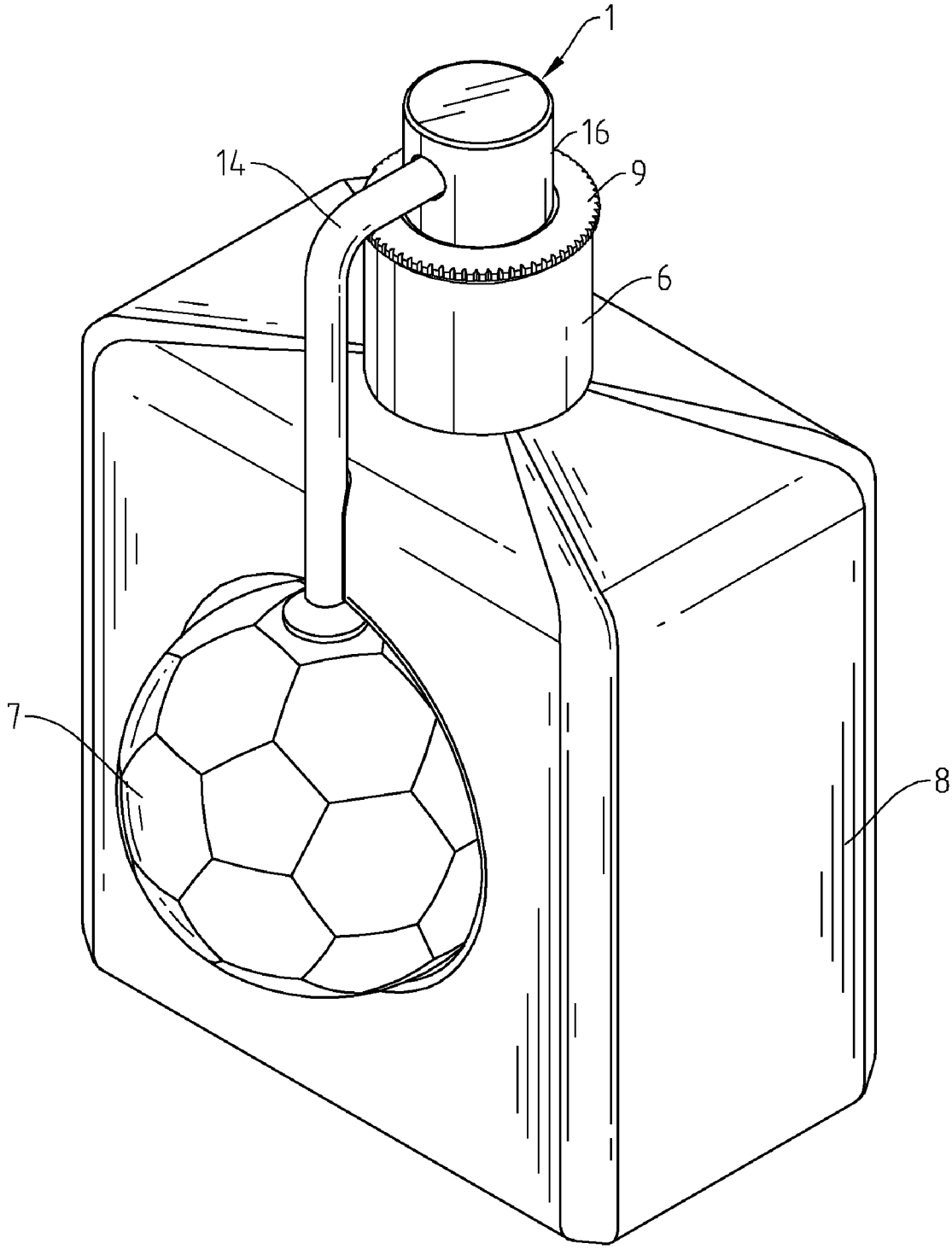
FIG. 1 is an elevational view, showing a perfume bottle spray head assembly used in a perfume sprayer according to the present invention.

Referring to FIGS. 1~4 and FIG. 7, a perfume bottle spray head assembly in accordance with the present invention is shown comprising a nozzle head 1, a lock cap 2, a receptacle 3, a plug 4, a dip tube 5, an outer cap 6, and a rotary shut-off control plate 9. The lock cap 2 holds the receptacle 3 and the plug 4 on the inside, and has its bottom end connected with one end of the dip tube 5. The outer cap 6 is capped on the lock cap 2. The rotary shut-off control plate 9 is set between the outer cap 6 and the nozzle head 1.

Figure 2:
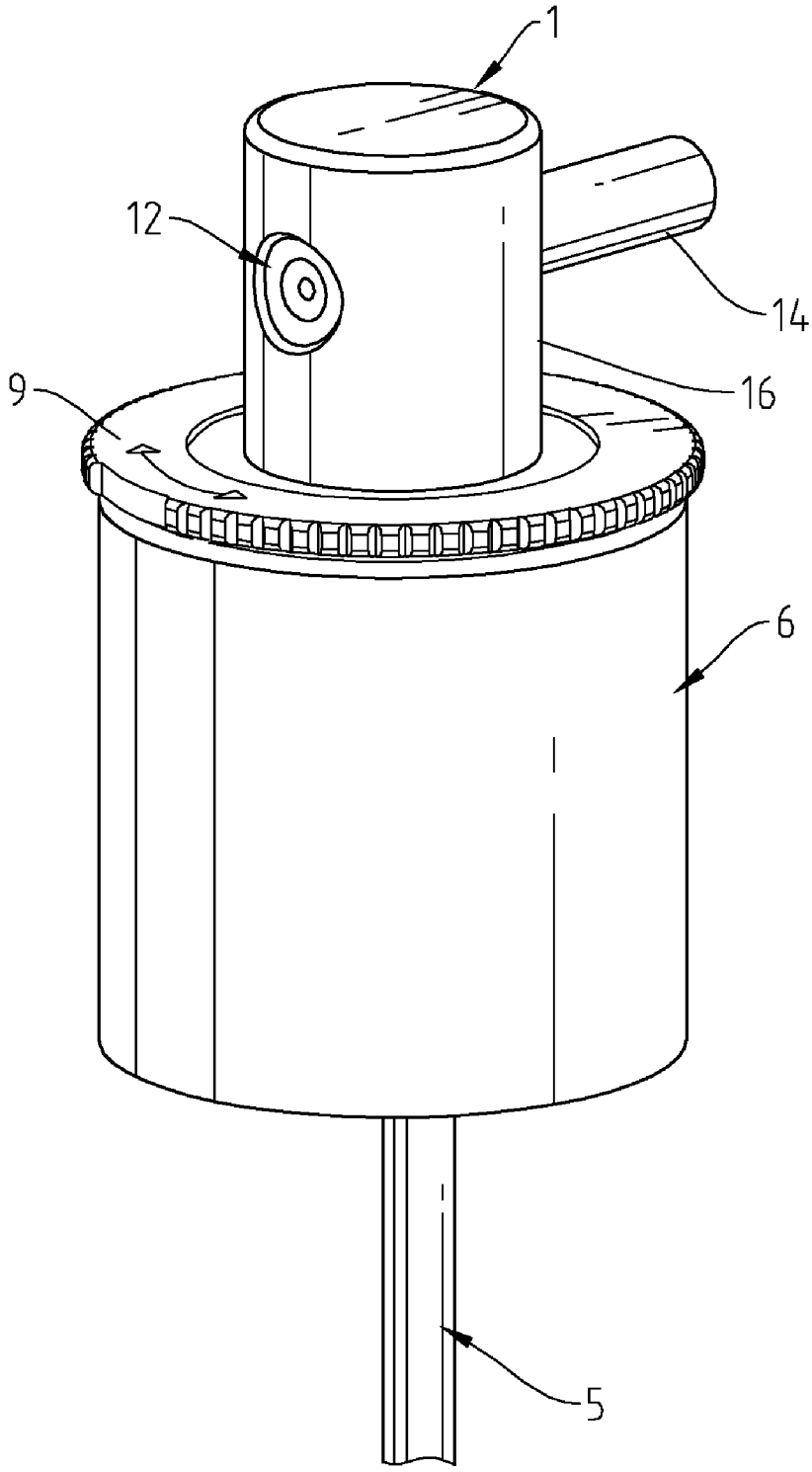
FIG. 2 is an elevational assembly view of the perfume bottle spray head assembly according to the present invention.
Figure 3:
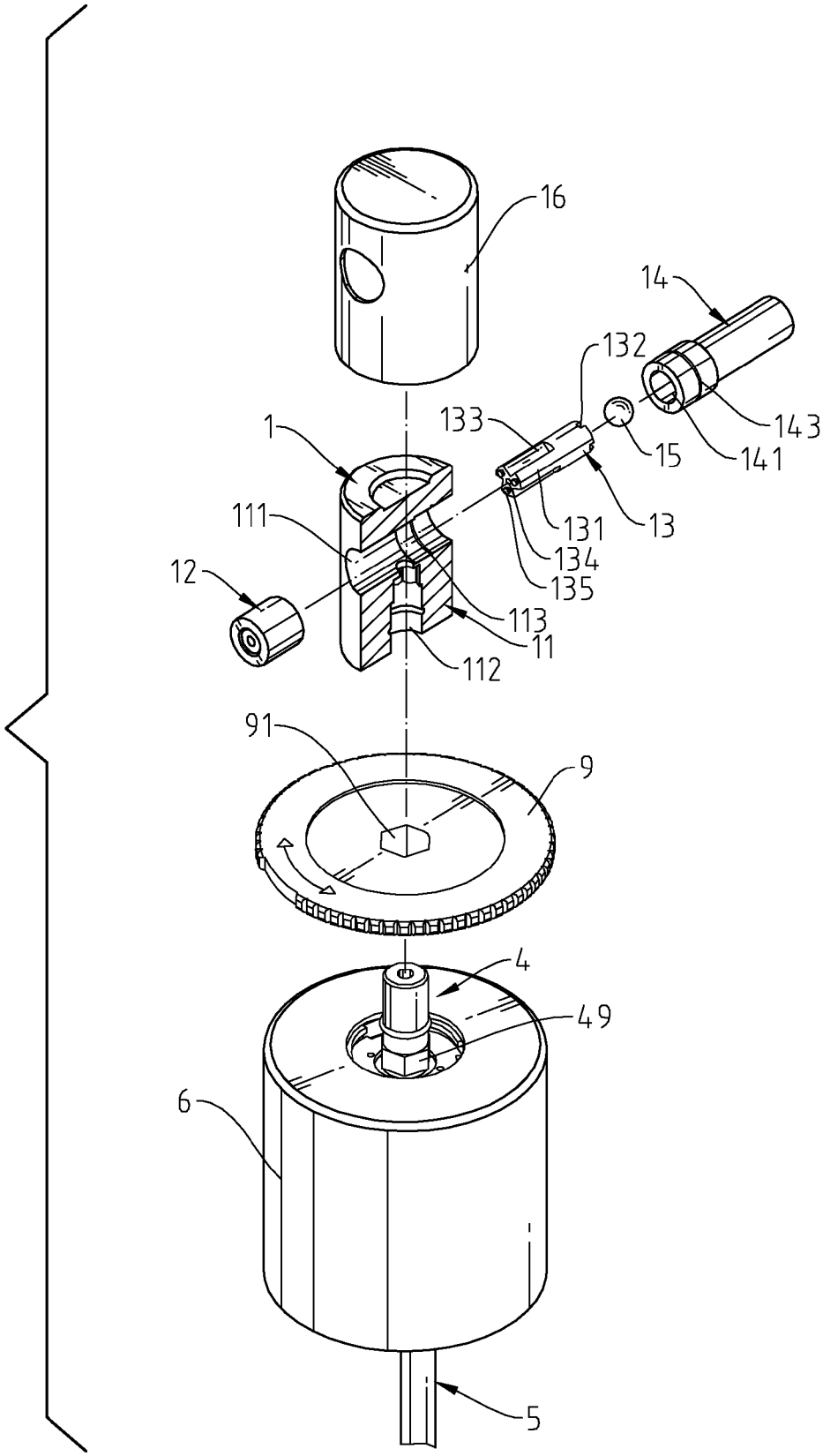
FIG. 3 is an exploded view of the perfume bottle spray head assembly according to the present invention.
Figure 4:
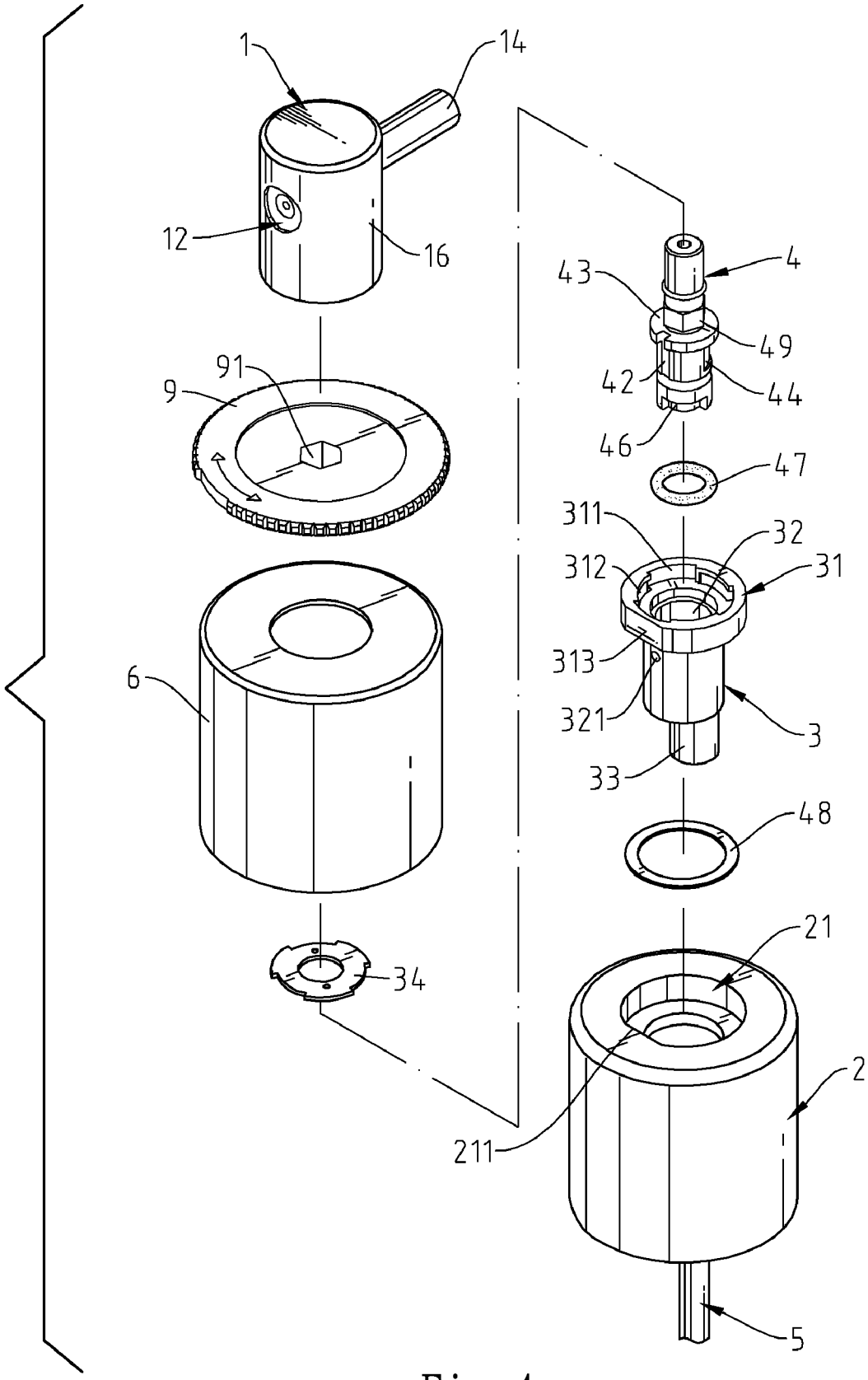
FIG. 4 is another exploded view of the perfume bottle spray head assembly according to the present invention.
Figure 5:
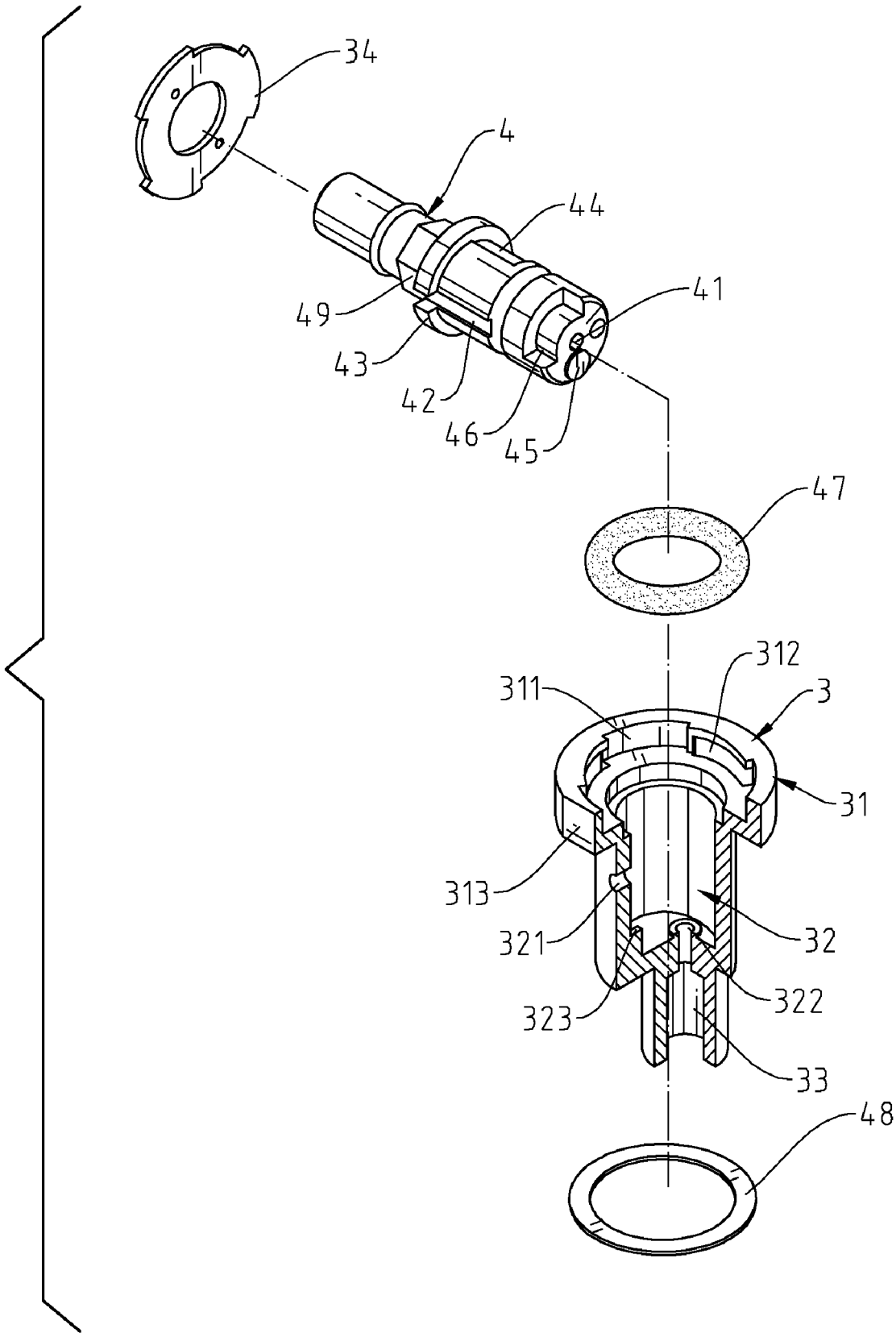
FIG. 5 is an exploded view of a part of the perfume bottle spray head assembly according to the present invention.

Referring to FIGS. 1~3, the nozzle head 1 is comprised of a casing 11, a nozzle 12, a gas guide 13, a gas intake tube 14, a ball 15 and a cover 16. The casing 11, the nozzle 12, the gas guide 13, the gas intake tube 14 and the ball 15 are assembled together and then mounted with the cover 16, facilitating installation and avoiding biasing of the casing 11.

The casing 11 has a transverse receiving hole 111 that receives the nozzle 12 and the gas intake tube 14, an axial hole 112 perpendicularly downwardly extended from the transverse receiving hole 111 to the bottom side, and an annular groove 113 extending around the inside wall inside the transverse receiving hole 111. The nozzle 12 defines therein an accumulation chamber 121. The gas guide 13 has a cylindrical body 131, a gas hole 134 axially extending through the cylindrical body 131, a plurality of notches 132 located on one end of the cylindrical body 131, a plurality of guide grooves 133 spaced around the periphery and axially extended to the other end of the cylindrical body 131, and a plurality of stub rods 135 protruded from the other end of the cylindrical body 131 adjacent to the guide grooves 133.

The gas intake tube 14 has one end connected to a hand pump 7 for guiding in a compressed gas from the hand pump 7 for forcing liquid perfume out of the nozzle 12, and the other end terminating in a ball hole 141 that accommodates the ball 15. The gas intake tube 14 further has an outside annular flange 143 extending around the periphery near the ball hole 141.

When assembling the nozzle head 1, insert one end of the cylindrical body 131 of the gas guide 13 into the ball hole 141 of the gas intake tube 14 and the other end of the cylindrical body 131 of the gas guide 13 into the accumulation chamber 121 of the nozzle 12 to have the guide grooves 133 be partially received inside the nozzle 12 and partially exposed to the outside of the nozzle 12 for guiding liquid perfume. When the nozzle 12, the gas guide 13 and the gas intake tube 14 are assembled together, the assembly of the nozzle 12, the gas guide 13 and the gas intake tube 14 is inserted directly into the transverse receiving hole 111 of the casing 11, forcing the outside annular flange 143 into engagement with the inside annular groove 113 in the transverse receiving hole 111.

Figure 9:
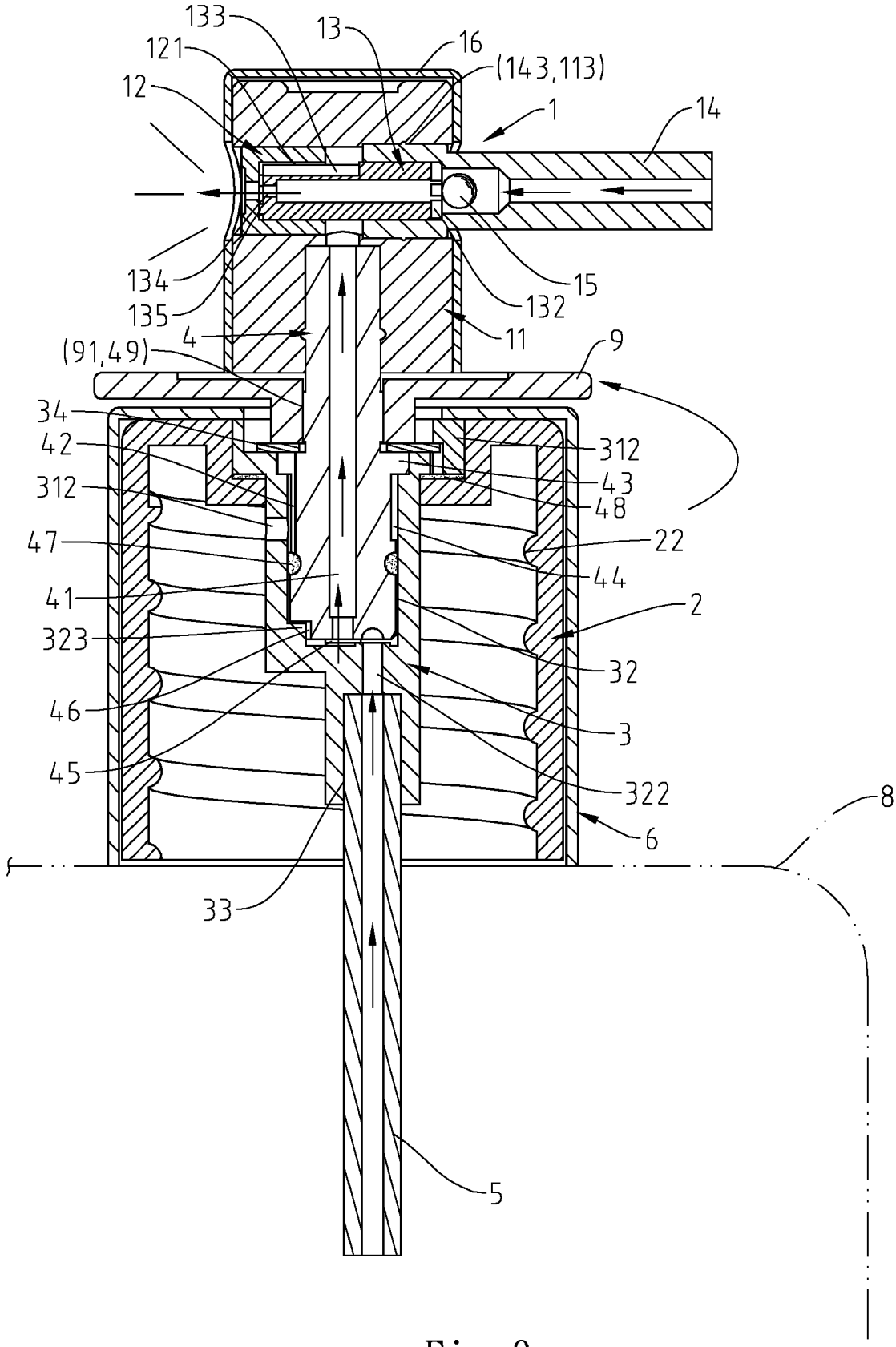
FIG. 9 is another sectional view of the present invention, showing the perfume bottle spray head assembly opened.

Referring to FIG. 3 and FIG. 9, after the nozzle 12, the gas guide 13 and the gas intake tube 14 have been assembled and positioned in the transverse receiving hole 111 of the casing 11, the nozzle 12 is positioned in one end, namely, the front end of the transverse receiving hole 111, and the part of the cylindrical body 131 of the gas guide 13 that exposed to the outside of the nozzle 12 and the gas intake tube 14 is kept in communication with the axial hole 112. As stated above, the gas guide 13 has notches 132 and stub rods 135 respectively disposed at the two opposite ends. The notches 132 enable compressed gas to pass from the gas intake tube 14 into the gas hole 134 of the gas guide 13. The stub rods 135 of the gas guide 13 work as spacer means to keep the associating end of the gas guide 13 away from the nozzle 12 for enabling liquid perfume to flow from the axial hole 112 into the guide grooves 133 and the accumulation chamber 121 of the nozzle 12. When compressed gas enters the gas intake tube 14, a gap is defined between the notches 132 of the gas guide 13 and the ball hole 141 of the gas intake tube 14 so that compressed gas enter the gas guide 13. At this time, the pressure of compressed gas induces a suction force to suck liquid perform into the inside of the casing 11 for mixing with compressed gas for enabling liquid perfume and gas mixture to be ejected through the gap between the gas guide 13 and the accumulation chamber 121 of the nozzle 12 around the stub rods 135 in the form of a mist.

Referring to FIGS. 3~5 and FIG. 9, the lock cap 2, the receptacle 3, the plug 4, the dip tube 5, the outer cap 6 and the rotary shut-off control plate 9 are provided at the bottom side of the nozzle head 1, constituting an anti-leak structure. The lock cap 2, the receptacle 3 and the plug 4 are mounted inside the outer cap 6. The plug 4 joins the rotary shut-off control plate 9 and the nozzle head 1.

The lock cap 2 has an inner thread 22 for threading onto the bottleneck (not shown) a perfume bottle 8, a stepped top hole 21, which receives the receptacle 3, and a vertical cut plane 211 disposed inside the stepped top hole 21.

The receptacle 3 is a stepped tube, having a body 31 set in the stepped top hole 21, a top recess 311 defined in the body 31 at the top side, a plurality of lugs 312 protruded from the inside wall of the body 31 and equiangularly spaced around the top side of the top recess 311, a chamber 32 defined in the body 31 at the center of the top recess 311, a vertical cut plane 313 located on the periphery of the body 31 and abutted against the vertical cut plane 211 of the lock cap 2, a bottom extension tube 33 downwardly extended from the chamber 32 for the connection of the dip tube 5.

The plug 4 is pivotally connected with its top end to the nozzle head 1, having an axial through hole 41 cut through the top and bottom ends, an O-ring 47 fastened to the periphery near the bottom end, a flange 43 extending around the periphery on the middle, a gasket ring 48 fastened to the periphery and stopped between the flange 43 and the lock cap 2 to prohibit leakage, a non-circular driven portion 49 disposed at the top side of the flange 43, a fluid groove 42 located on the periphery and axially extending between the flange 43 and the O-ring 47, a recessed portion 44 located on the periphery corresponding to the chamber 32 of the receptacle 3 to minimize friction noise during rotation of the plug 4 relative to the receptacle 3.

The receptacle 3 further has a gas hole 321 transversely extended from the chamber 32 to the outside, a stop block 323 disposed at the bottom side inside the chamber 32, and a guide hole 322 eccentrically cut through the bottom side of the body 31 in communication between the chamber 32 and the inside space of the bottom extension tube 33. When inserted the plug 4 into the receptacle 3, the flange 43 of the plug 4 is received the top recess 311, and the lower part of the plug 4 is suspending in the chamber 32. To avoid disconnection of the plug 4 from the receptacle 3, a retaining ring 34 is fastened to the plug 4 and stopped in the top recess 311 beneath the lugs 312. Thus, the plug 4 is rotatable relative to the receptacle 3 and prohibited from falling out of the receptacle 3.

Figure 6:
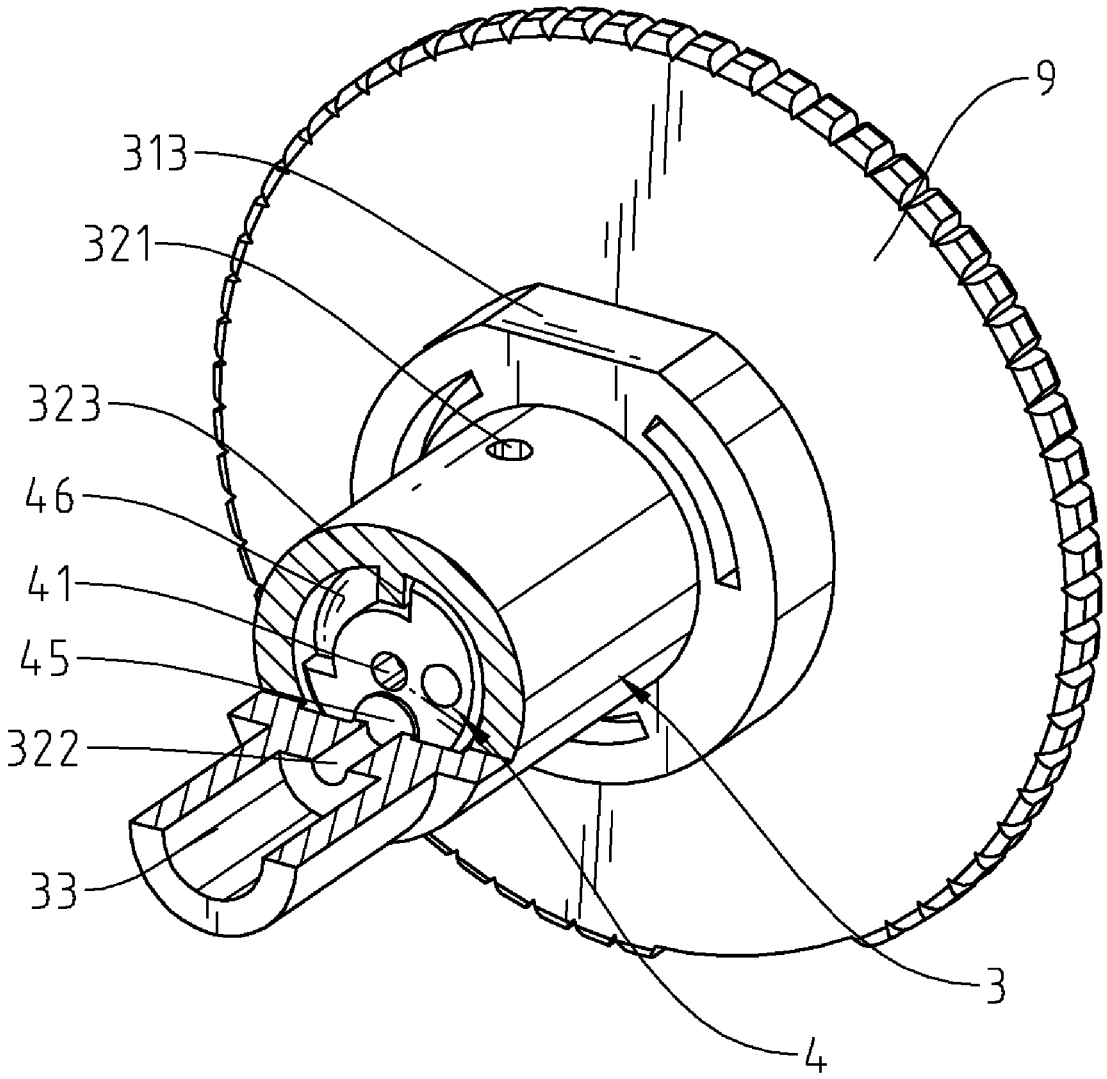
FIG. 6 is a sectional elevation of a part of the present invention, showing the arrangement of the rotary shut-off control plate, the plug and the receptacle.
Figure 7:
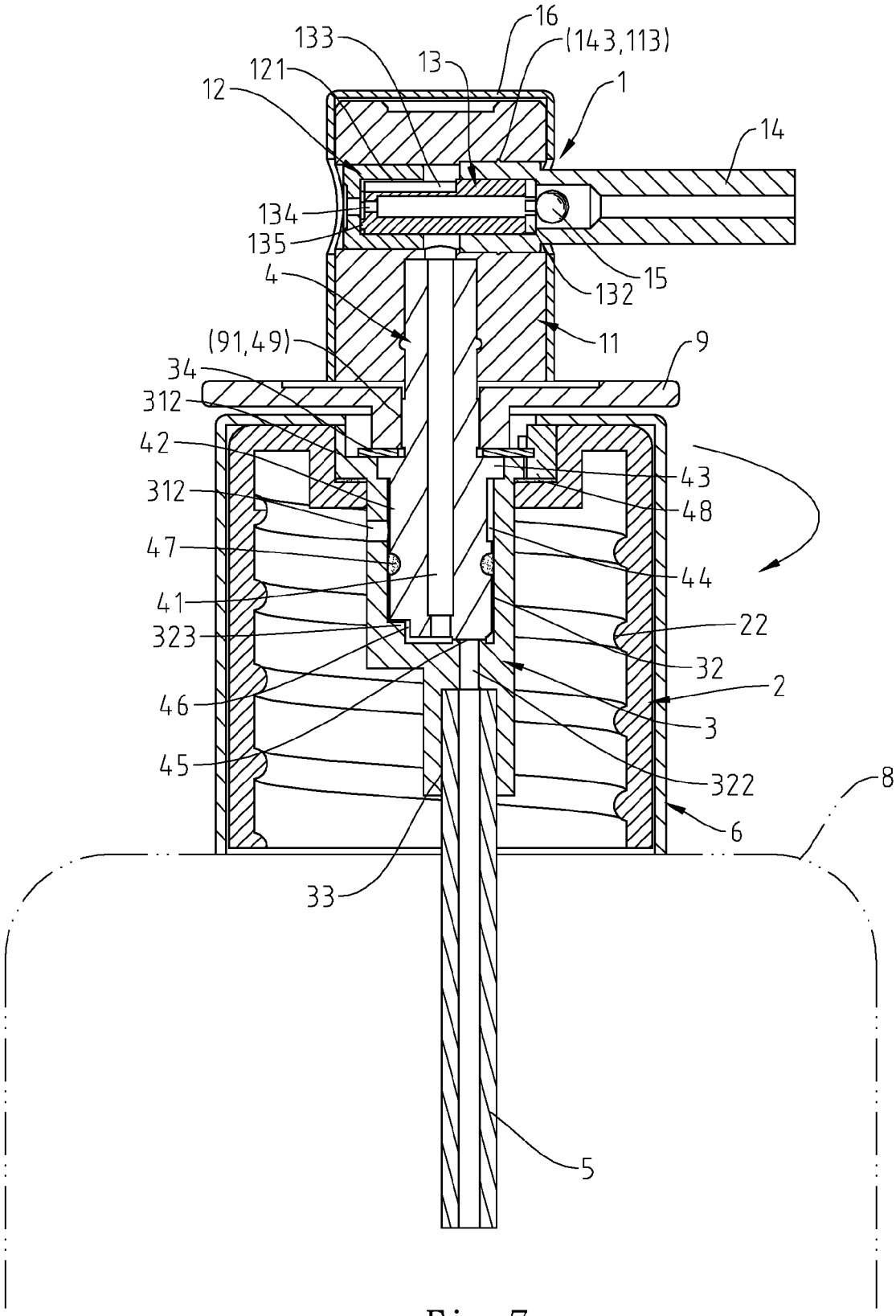
FIG. 7 is a sectional view of the present invention, showing the perfume bottle spray head assembly closed.

Further, after the plug 4 and the receptacle 3 has been assembled and set in the lock cap 2, the outer cap 6 is capped on the lock cap 2. Further, the rotary shut-off control plate 9 has a non-circular center mounting hole 91 fastened to the non-circular driven portion 49 of the plug 4. As shown in FIGS. 6 and 7, the top end of the plug 4 is pivotally connected to the nozzle head 1. When rotating the rotary shut-off control plate 9, the plug 4 is rotated with the rotary shut-off control plate 9 relative to the receptacle 3. The plug 4 further has a bottom groove 46 extending around the periphery at the bottom side at an angle about 90° and coupled to the stop block 323 in the chamber 32 of the receptacle 3 to limit the angle of rotation of the plug 4 relative to the receptacle 3. The plug 4 further has a bottom protruding block 45 (see FIG. 6).

Referring to FIGS. 6 and 7, when rotating the rotary shut-off control plate 9 through 90°, the plug 4 is rotated with the rotary shut-off control plate 9 through 90° to force the bottom protruding block 45 into the guide hole 322 of the receptacle 3, thereby closing the guide hole 322 (the liquid perfume passage between the dip tube 5 and the plug 4), and therefore the perfume bottle 8 is sealed and prohibited from leakage.

Figure 8:
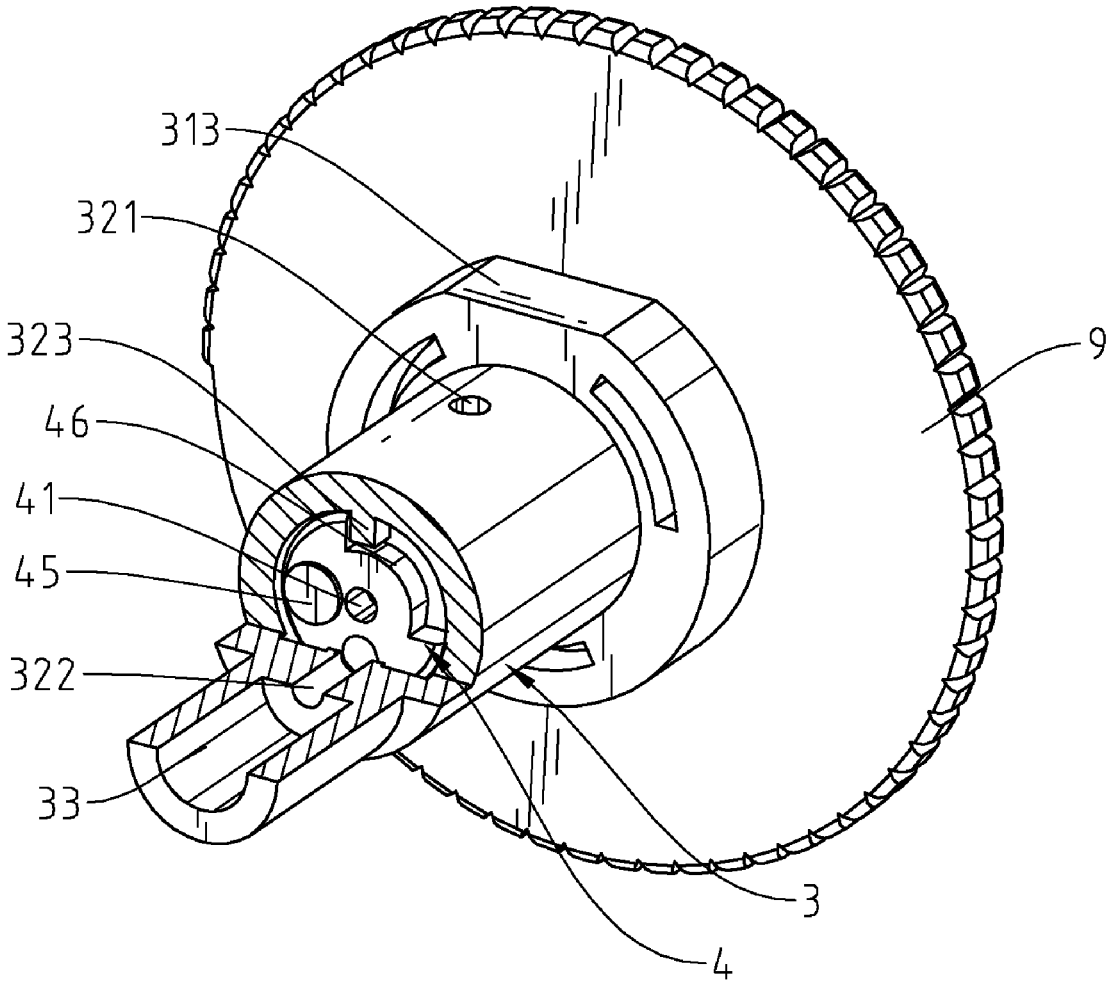
FIG. 8 is similar to FIG. 6 but showing the bottom protruding block of the plug moved away from the guide hole of the receptacle.

Referring to FIGS. 8 and 9, the rotary shut-off control plate 9 can be operated to rotate the plug 4 to the close position to close the guide hole 322, preventing leakage. When wishing to open the nozzle head 1, operate the rotary shut-off control plate 9 to rotate the plug 4 in the reversed direction through 90° and have the bottom protruding block 45 be moved away from the guide hole 322 of the receptacle 3, thereby opening the guide hole 322 for enabling liquid perform to pass through the axial through hole 41 into the nozzle head 1 for mixing with compressed air for enabling liquid perfume and gas mixture to be ejected out of the nozzle head 1 in the form of a mist.

Further, the gas hole 321 of receptacle 3 allows external air to enter the chamber 32, keeping the inside air pressure of the chamber 32 in balance with the atmosphere pressure, avoiding an overflow.

Referring to FIGS. 1, 7 and 9, by means of operating the rotary shut-off control plate 9 to rotate the plug 4 between two reversed positions, the perform bottle 8 is closed or opened. When the perfume sprayer is not used or during transportation of the perfume sprayer, the rotary shut-off control plate 9 is operated to rotate the plug 4 to the close position to close the liquid perfume passage, preventing leakage. When wishing to use the perfume sprayer, operate the rotary shut-off control plate 9 to rotate the plug 4 to the open position, for enabling liquid perfume and gas mixture to be ejected out of the nozzle head 1 in the form of a mist upon compression of the hand pump 1.

Further, because the nozzle head 1 is pivotally coupled to the top end of the plug 4, operating the rotary shut-off control plate 9 to rotate the plug 4 does not cause rotation of the nozzle head 1 with the plug 4, and the gas intake tube 14 will never be twisted during rotation of the plug 4. Thus, the hand pump 7 can be positively positioned in one side of the perfume bottle 8 that can be made in any of a variety of designs.

Although particular embodiments of the invention have been described in detail for purposes of illustration, various modifications and enhancements may be made without departing from the spirit and scope of the invention.

What is claimed is:

1. A perfume bottle spray head assembly, comprising:

a nozzle head;

a lock cap, said lock cap having a stepped top hole;

a receptacle, said receptacle having a body set in said stepped top hole of said lock cap, a top recess defined in a top side of said body, a plurality of lugs protruded from an inside wall of said body and equiangularly spaced around said top recess at a top side, a chamber defined in said body at the center of said top recess, a bottom extension tube downwardly extended from a bottom side of said body and inserted into the inside of said lock cap and connected to a top end of a dip tube, a stop block disposed at a bottom side inside said chamber, and a guide hole eccentrically cut through the bottom side of said body in communication between said chamber and the inside space of said bottom extension tube;

a plug set in between said nozzle and said receptacle pivotally connected to said nozzle head at a bottom side, said plug having an axial through hole cut through top and bottom ends thereof in communication with said chamber of said receptacle, a flange extending around the periphery thereof on the middle, a non-circular driven portion disposed at a top side of the flange, a bottom groove extending around the periphery at a bottom side at an angle about 90° and coupled to said stop block in said chamber of said receptacle to limit the angle of rotation of said plug relative to said receptacle, and a bottom protruding block corresponding to said guide hole of said receptacle;

a retaining ring fastened to the periphery of said plug and set in said top recess of said body of said receptacle and stopped beneath said lugs to secure said plug to said receptacle;

an outer cap capped on said lock cap to hold said receptacle and said plug in place;

a rotary shut-off control plate set between said nozzle head and said outer cap for rotating said plug, said rotary shut-off control plate having a non-circular center mounting hole fastened to said non-circular driven portion of said plug for allowing said plug to be rotatable with said rotary shut-off control plate between a close position where said bottom protruding block of said plug is engaged into said guide hole of said receptacle to stop the passage of said guide hole and an open position where said bottom protruding block of said plug is disengaged from said guide hole of said receptacle to open the passage of said guide hole.

2. The perfume bottle spray head assembly as claimed in claim 1, wherein said lock cap has a vertical cut plane disposed in said stepped top hole at one side; said receptacle has a vertical cut plane located on the periphery of the body thereof and abutted against the vertical cut plane of said lock body.

3. The perfume bottle spray head assembly as claimed in claim 1, wherein said plug has a recessed portion located on the periphery thereof corresponding to said chamber of said receptacle.

4. The perfume bottle spray head assembly as claimed in claim 1, wherein said receptacle has a gas hole transversely extended from said chamber to the outside.

* * * * *